US006353936B2

(12) United States Patent
Flatt

(10) Patent No.: US 6,353,936 B2
(45) Date of Patent: Mar. 12, 2002

(54) PERSPIRATION REDIRECTING HEAD BAND APPARATUS

(76) Inventor: Erick P. Flatt, 8812 Rolling Rock La., Dallas, TX (US) 75238

( * ) Notice: Subject to any disclaimer, the term of this patent is extended or adjusted under 35 U.S.C. 154(b) by 0 days.

(21) Appl. No.: 09/740,153

(22) Filed: Dec. 18, 2000

Related U.S. Application Data

(60) Provisional application No. 60/173,865, filed on Dec. 30, 1999.

(51) Int. Cl.[7] ..... A42B 1/00

(52) U.S. Cl. ..... 2/181; 2/174; 2/DIG. 11; 604/312

(58) Field of Search ..... 2/181, 181.2, 181.4, 2/181.6, 181.8, 182.8, 174, DIG. 11, 171.2, 171.3, 425, 171; 604/19, 312

(56) References Cited

U.S. PATENT DOCUMENTS

| | | | | | |
|---|---|---|---|---|---|
| 1,750,937 | A | * | 3/1930 | Morgan | 2/171 |
| 2,320,782 | A | * | 6/1943 | Larsen | 2/171 |
| 4,368,545 | A | * | 1/1983 | Seidman | 2/174 |
| 4,626,247 | A | * | 12/1986 | Frankel | 604/312 |
| 4,638,512 | A | * | 1/1987 | Frankel | 2/171 |
| 5,073,989 | A | | 12/1991 | Teague | |
| 5,146,630 | A | * | 9/1992 | Richard | 2/181 |
| 5,175,887 | A | | 1/1993 | Kim | |
| 5,590,422 | A | | 1/1997 | Henderson | |
| 5,600,854 | A | * | 2/1997 | Henrekin | 2/195.2 |
| 5,740,556 | A | * | 4/1998 | Brown | 2/181 |
| 5,781,932 | A | * | 7/1998 | Brown | 2/181 |
| 5,901,381 | A | | 5/1999 | Nelson | |
| 5,926,849 | A | | 7/1999 | Boyle | |

* cited by examiner

*Primary Examiner*—Bibhu Mohanty
*Assistant Examiner*—Katherine Moran

(57) ABSTRACT

A head band apparatus is provided for protecting a wearer's eyes from perspiration from the wearer's forehead and includes a band which has a front band portion, a rear band portion, and side band portions between the front band portion and the rear band portion. The front band portion includes a front band outer side, and the side band portions includes side band outer sides. A perspiration collector lip is connected to the front band portion and extends outward from the front band outer side for defining a collection space between the perspiration collector lip and the front band portion. The perspiration collector lip includes a first open drain end laterally distanced from the wearer's eyes. A second open drain end is also provided and is also laterally distanced from the wearer's eyes.

3 Claims, 4 Drawing Sheets

FIG 1
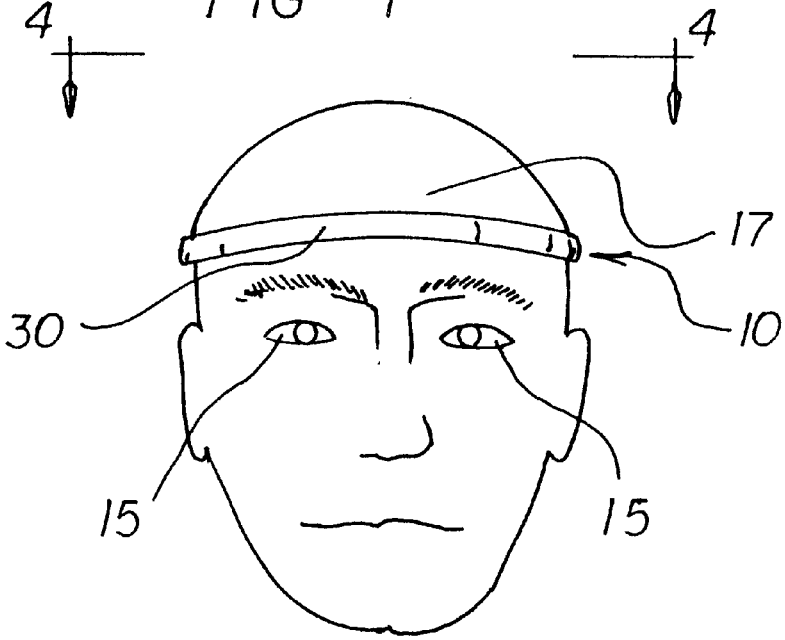
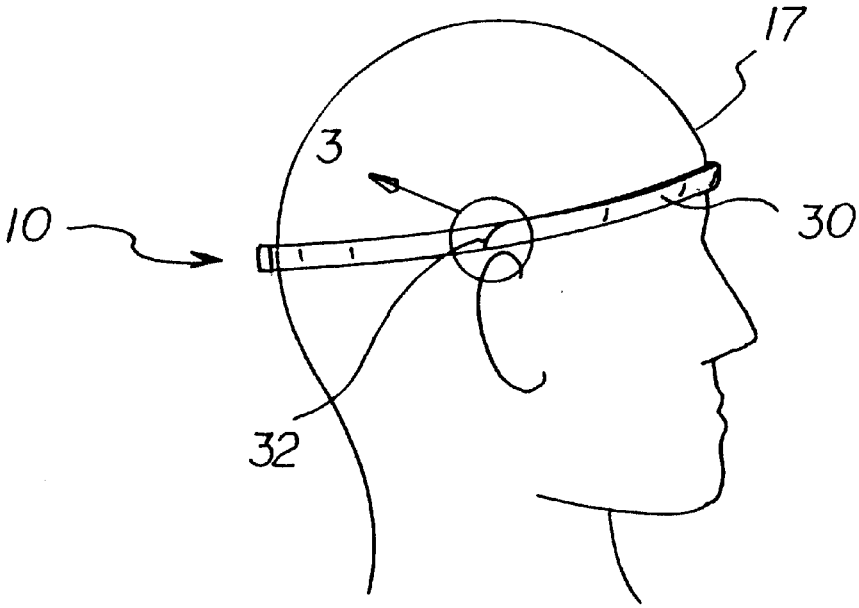
FIG 2

FIG 3
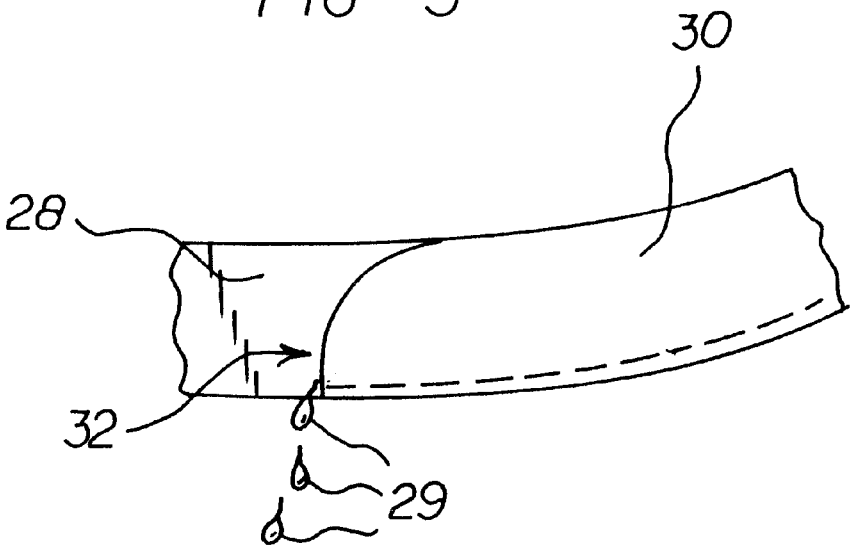
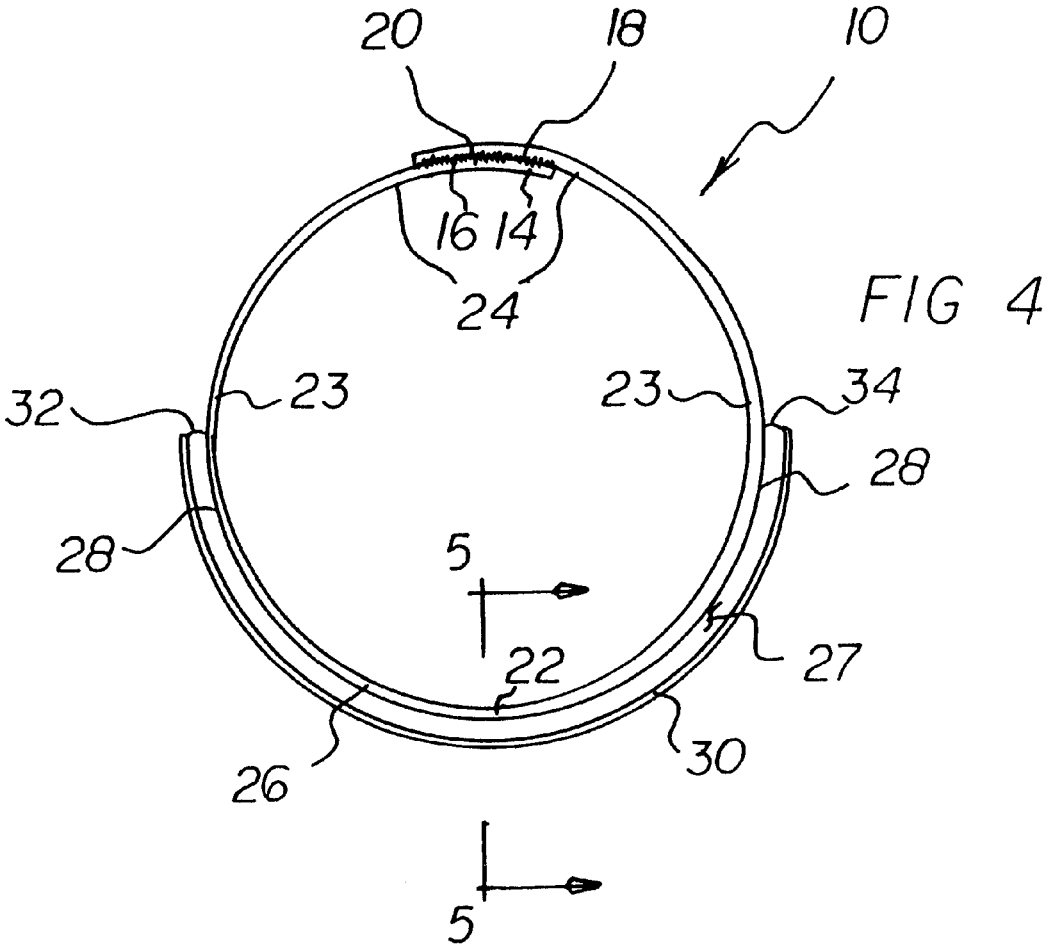
FIG 4

FIG 5
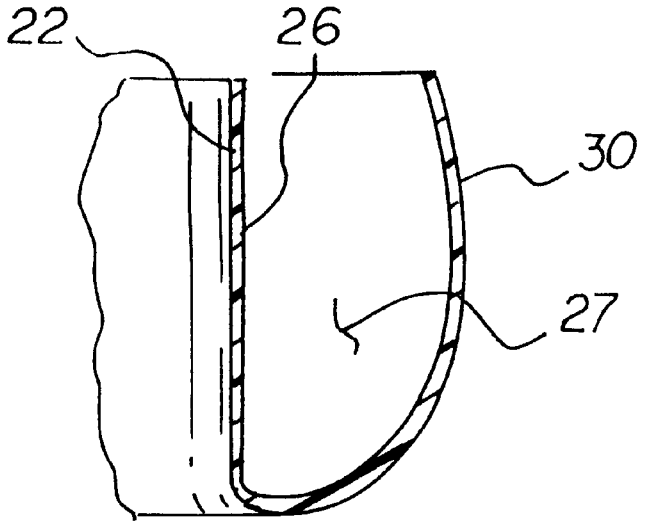
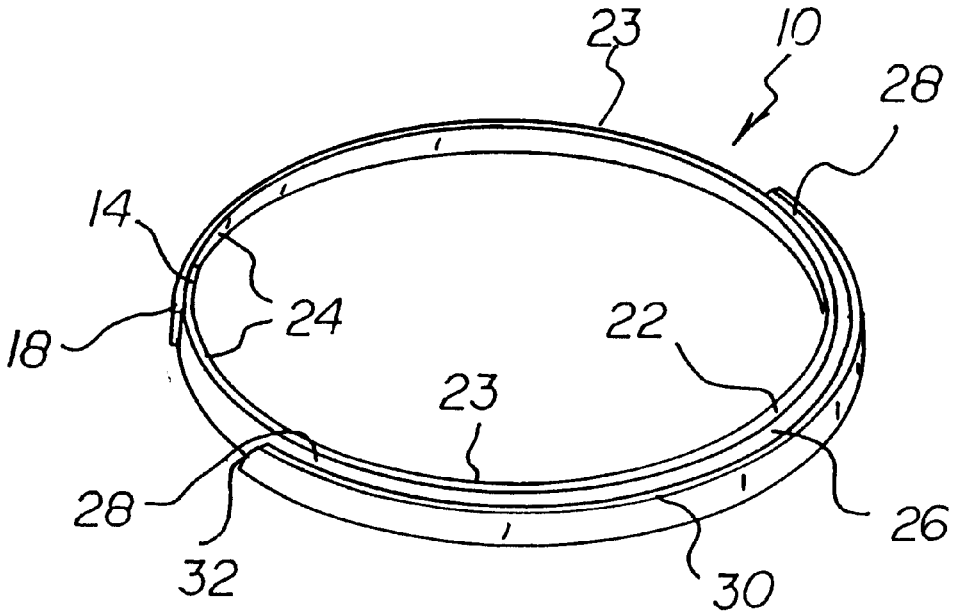
FIG 6

PERSPIRATION REDIRECTING HEAD BAND APPARATUS

CROSS-REFERENCE TO RELATED APPLICATION

This application claims priority based upon my copending Provisional application Ser. No. 60/173,865; filed Dec. 30, 1999.

BACKGROUND OF THE INVENTION

1. Field of the Invention

The present invention relates generally to head bands and, more particularly, to head bands especially adapted for handling perspiration.

2. Description of the Prior Art

It is well known that when a person perspires, the perspiration from one's forehead flows downward and often flows into one's eyes. To overcome this problem numerous head bands are known which absorb the perspiration on the forehead before it can flow into one's eyes. In this respect, throughout the years, a number of innovations have been developed relating to perspiration absorbent head bands, and the following U. S. patents are representative of some of those innovations: U.S. Pat. Nos. 5,073,989, 5,590,422, 5,901,381, and 5,926,849. One problem associated with any head band that absorbs perspiration is the problem of saturation. When the head band becomes saturated with perspiration, it can no longer absorb perspiration. As a result, either the wearer must take the head band off and squeeze out the absorbed perspiration, or excess perspiration will flow out from the saturated absorbent. To overcome the problems associated with head bands that absorb perspiration, it would be desirable if a head band were provided which prevents perspiration from flowing into a wearer's eyes without absorbing perspiration.

It is conceived by the present inventor herein, that it would be desirable to drain perspiration away from a person's eyes, rather than absorb perspiration. In this respect, it would be desirable if a head band were provided that drains perspiration a suitable distance away from a person's eyes.

For a head band to be useful to many persons, it would be desirable if the head band were easily adjustable. With adjustable straps, often a free end of an adjustable strap will be loose and flop around. A flopping around loose end of an adjustable strap can be annoying to a wearer of an adjustable head band, so it would be desirable if an adjustable head band were provided that has means for securing a free end of an adjustable strap.

Thus, while the foregoing body of prior art indicates it to be well known to use head bands to prevent perspiration from a person's forehead from flowing into the person's eyes, the prior art described above does not teach or suggest a perspiration redirecting head band apparatus which has the following combination of desirable features: (1) prevents perspiration from flowing into a wearer's eyes without absorbing the perspiration; (2) is easily adjustable; (3) drains perspiration away from a person's eyes, rather than absorb perspiration; (4) drains perspiration a substantial distance away from a person's eyes; and (5) has means for securing a free end of an adjustable strap so that it will not flop around.

The foregoing desired characteristics are provided by the unique perspiration redirecting head band apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a head band apparatus for protecting a wearer's eyes from perspiration from the wearer's forehead and includes a band which includes an outer side. A non-absorbent perspiration collector lip is connected to the outer side of the band and extends outward from the band outer side for defining a collection space between the perspiration collector lip and the band. The perspiration collector lip includes a first open drain end laterally distanced from the wearer's eyes, whereby perspiration from the wearer's forehead is directed by the perspiration collector lip away from the wearer's eyes.

More specifically, the head band apparatus includes a band which has a front band portion, a rear band portion, and side band portions between the front band portion and the rear band portion. The front band portion includes a front band outer side, and the side band portions includes side band outer sides. A non-absorbent perspiration collector lip is connected to the front band portion and extends outward from the front band outer side for defining a collection space between the perspiration collector lip and the front band portion. The perspiration collector lip includes a first open drain end laterally distanced from the wearer's eyes. A second open drain end is also provided and is also laterally distanced from the wearer's eyes.

Preferably, the perspiration collector lip is further connected to the side band portions and further extends outward from the side band outer sides, whereby the collection space is further extended between the perspiration collector lip and the side band portions. As a result, the first open drain end is adjacent to one of the side band portions, and the second open drain end is adjacent to another of the side band portions. The front band portion is substantially flat to be flat against the wearer's forehead.

The band includes a first band end which includes a first band connector, and the band includes a second band end which includes a second band connector. The first band connector includes a first hook or loop material, and the second band connector includes a second loop or hook material.

With another embodiment of the invention, the band includes a first band end includes a pair of strap lock rings. A second band end includes a quantity of third hook or loop material on an outside surface of the second band end at the free end of the second band end and includes a quantity of fourth loop or hook material on the outside surface of the second band end distal from the third hook or loop material. The strap lock rings serve to lock the second band end in a desired adjustment, and interengagement of the third hook or loop material and the fourth loop or hook material prevent the free end of the second band end from flopping around.

With a third embodiment of the invention, the front band portion includes a downward sloping top edge. The downward sloping top edge facilitates the flow of perspiration from a wearer's forehead into the collection space between the perspiration collector lip and the front band portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved perspiration redirecting head band apparatus which has all of the advantages of the prior art and none of the disadvantages.

It is another object of the present invention to provide a new and improved perspiration redirecting head band apparatus which may be easily and efficiently manufactured and marketed.

It is a further object of the present invention to provide a new and improved perspiration redirecting head band apparatus which is of durable and reliable construction.

An even further object of the present invention is to provide a new and improved perspiration redirecting head band apparatus which is susceptible of a low cost of manufacture with regard to both materials and labor, and which accordingly is then susceptible of low prices of sale to the consuming public, thereby making such perspiration redirecting head band apparatus available to the buying public.

Still yet a further object of the present invention is to provide a new and improved perspiration redirecting head band apparatus which prevents perspiration from flowing into a wearer's eyes without absorbing the perspiration.

Still another object of the present invention is to provide a new and improved perspiration redirecting head band apparatus that is easily adjustable.

Yet another object of the present invention is to provide a new and improved perspiration redirecting head band apparatus which drains perspiration away from a person's eyes, rather than absorb perspiration.

Even another object of the present invention is to provide a new and improved perspiration redirecting head band apparatus that drains perspiration a substantial distance away from a person's eyes.

Still a further object of the present invention is to provide a new and improved perspiration redirecting head band apparatus which has means for securing a free end of an adjustable strap so that it will not flop around.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a front view showing a first embodiment of the perspiration redirecting head band apparatus of the invention in use on a wearer's head.

FIG. 2 is a side view of the embodiment of the perspiration redirecting head band apparatus shown in FIG. 1.

FIG. 3 is an enlarged side view of the portion of the embodiment of the invention shown in the circled area 3 of FIG. 2.

FIG. 4 is a top view of the embodiment of the invention shown in FIG. 1 taken along line 4—4 thereof.

FIG. 5 is an enlarged cross-sectional view of the embodiment of the invention shown in FIGS. 1–4 taken along line 5—5 of FIG. 4.

FIG. 6 is a perspective view of the embodiment of the invention shown in FIGS. 1–5.

DESCRIPTION OF THE PREFERRED EMBODIMENT

Figure 7:
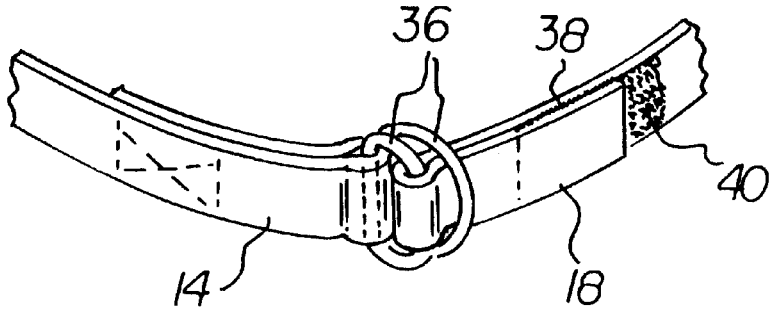
FIG. 7 is a perspective view of a second embodiment of the invention.

With reference to the drawings, new and improved perspiration redirecting head band apparatuses embodying the principles and concepts of the present invention will be described.

Turning to FIGS. 1–6, there is shown a first embodiment of the perspiration redirecting head band apparatus of the invention generally designated by reference numeral 10. In the first embodiment, perspiration redirecting head band apparatus 10 is provided for protecting a wearer's eyes 15 from perspiration from the wearer's forehead 17 by redirecting perspiration away from the wearer's eyes. The perspiration redirecting head band apparatus 10 includes a band which has a front band portion 22, a rear band portion 24, and side band portions 23 between the front band portion 22 and the rear band portion 24. The front band portion 22 includes a front band outer side 26, and the side band portions 23 includes side band outer sides 28. A non-absorbent perspiration collector lip 30 is connected to the front band portion 22 and extends outward from the front band outer side 26 for defining a collection space 27 between the perspiration collector lip 30 and the front band portion 22. By being "non-absorbent", the perspiration collector lip 30 does not absorb perspiration. The perspiration collector lip 30 includes a first open drain end 32 laterally distanced from the wearer's eyes 15. A second open drain end 34 is also provided and is also laterally distanced from the wearer's eyes 15.

Preferably, the perspiration collector lip 30 is further connected to the side band portions 23 and further extends outward from the side band outer sides 28, whereby the collection space 27 is further extended between the perspiration collector lip 30 and the side band portions 23. As a result, the first open drain end 32 is adjacent to one of the side band portions 23, and the second open drain end 34 is adjacent to another of the side band portions 23. The front band portion 22 is substantially flat to be flat against the wearer's forehead 17.

The band includes a first band end 14 which includes a first band connector 16, and the band includes a second band end 18 which includes a second band connector 20. The first band connector 16 includes a first hook or loop material 16, and the second band connector 20 includes a second loop or hook material 20. The first hook or loop material 16 and the second loop or hook material 20 can be made from well known VELCRO(TM) material. Alternately, the band can be made of elastic material that encompasses a head.

To use the perspiration redirecting head band apparatus 10 of the invention, the first hook or loop material 16 is connected to the second loop or hook material 20 so that the band fits on a wearer's head as shown in the drawing figures. The front band portion 22 is positioned on the wearer's forehead 17 above the wearer's eyes 15. Then, when perspiration is formed on the wearer's forehead 17, the perspiration flows down the forehead 17 into the collection space 27 between the front band portion 22 and the perspiration collector lip 30. As perspiration accumulates in the collection space 27, the accumulated perspiration flows to the first open drain end 32 and the second open drain end 34 which are located away from the eyes 15 so that the eyes 15 are protected from the perspiration. FIG. 3 shows drops 29 of perspiration draining from the first open drain end 32. As shown in FIG. 2, the open drain ends can be located behind the ears of the wearer.

Turning to FIG. 7, a second embodiment of the invention is shown. Reference numerals are shown that correspond to like reference numerals that designate like elements shown in the other figures. In addition, the band includes a first band end 14 which includes a pair of strap lock rings 36. The strap lock rings 36 can be in the form of well known D-shaped rings. To attach the strap lock rings 36 to the first band end 14, the free end of the first band end 14 can be threaded through both of the strap lock rings 36. Then, the free end can be folded back onto the body of the first band end 14 and sewn thereto, thereby securing the strap lock rings 36 to the first band end 14. A second band end 18 includes a quantity of third hook or loop material 38 on an outside surface of the second band end 18 at the free end of the second band end 18. The second band end 18 also includes a quantity of fourth loop or hook material 40 on the outside surface of the second band end 18 distal from the third hook or loop material 38.

To use the embodiment of the invention shown in FIG. 7, the free end of the second band end 18 is threaded through the strap lock rings 36 so that the second band end 18 is locked in a desired position by the strap lock rings 36. Once this is done, the third hook or loop material 38 on the second band end 18 is pressed up against the fourth loop or hook material 40 so that the free end of the second band end 18 is fastened to the remainder of the second band end 18 so that the free end of the second band end 18 does not flop around when the band 99 is on a wearer. The third hook or loop material 38 and the fourth loop or hook material 40 can be made from well known VELCRO(TM) material.

Figure 8:
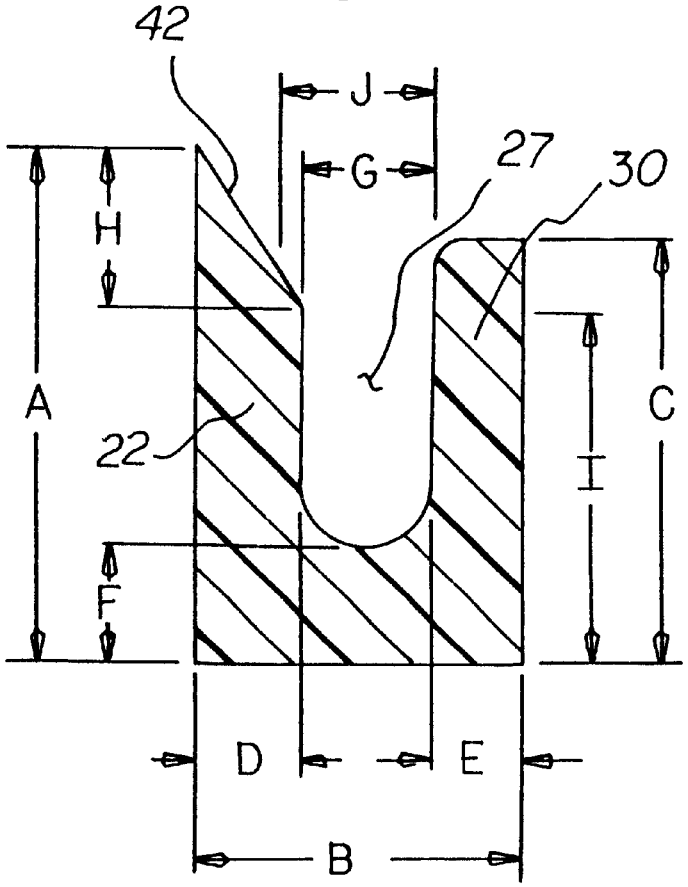
FIG. 8 is a cross-sectional view of a third embodiment of the invention, analogous to the cross-sectional view of the first embodiment of the invention shown in FIG. 5.

Turning to FIG. 8, a third embodiment of the invention is shown. Reference numerals are shown that correspond to like reference numerals that designate like elements shown in the other figures. In addition, the front band portion 22 includes a downward sloping top edge 42. The downward sloping top edge 42 facilitates the flow of perspiration 101 from a wearer's forehead into the collection space 27 between the perspiration collector lip 30 and the front band portion 22.

As shown in the cross-sectional view in FIG. 8, there are ten dimensional measurements that are designated in FIG. 8. Although specific dimensional measurements can be chosen in a wide range of suitable variation, a, specific embodiment of the invention is described with the following dimensions, referring to FIG. 8. Dimension A is 1.4 cm. Dimension B is 0.8 cm. Dimension C is 0.95 cm. Dimension D is 0.2 cm. Dimension E is 0.3 cm. Dimension F is 0.47 cm. Dimension G is 0.3 cm. Dimension H is 0.4 cm. Dimension I is 0.95 cm. Dimension J is 0.47 cm. The area defined by Dimension C can be a background for a logo. A logo can be embossed on the area defined by Dimension C to a depth of 0.1 cm. These dimensions are illustrative of a preferred embodiment of the invention and are not to be construed as limiting.

The band and the perspiration collector lip 30 can be made from thin plastic materials. More specifically, the entire band and perspiration collector lip can be made from flexible, nonabsorbent molded PVC. Since the band and the perspiration collector lip 30 are made from relatively thin materials, the perspiration redirecting head band apparatus 10 can be worn under a head covering, such as a helmet, baseball cap or the like.

The components of the perspiration redirecting head band apparatus of the invention can be made from inexpensive and durable plastic and cloth materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved perspiration redirecting head band apparatus that is low in cost, relatively simple in design and operation, and which may advantageously be used to provide a perspiration redirecting head band apparatus which prevents perspiration from flowing into a wearer's eyes without absorbing the perspiration. With the invention, a perspiration redirecting head band apparatus is provided which is easily adjustable. With the invention, a perspiration redirecting head band apparatus is provided which drains perspiration away from a person's eyes, rather than absorb perspiration. With the invention, the head band apparatus drains perspiration a suitable distance away from a person's eyes. With the invention, a perspiration redirecting head band apparatus is provided which has means for securing a free end of an adjustable strap so that it will not flop around.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A head band apparatus for protecting a wearer's eyes from perspiration from the wearer's forehead, comprising:

a substantially imperforate band which has a front band portion, a rear band portion, and side band portions between said front band portion and said rear band portion, wherein said front band portion includes a front band outer side, and wherein said side band portions include side band outer sides, a perspiration collector lip connected to said front band portion and extending outward from said front band outer side for defining a collection space between said perspiration collector lip an d said front band portion, wherein said perspiration collector lip includes a first open drain end laterally distanced from the wearer's eyes and a second open drain end laterally distanced from the wearer's eyes, wherein said perspiration collector lip is further connected to said side band portions and further extends outward from said side band outer sides and further extends said collection space between said perspiration collector lip and said side band portions, such that said first open drain end is adjacent to one of said side band portions and said second open drain end is adjacent to another of said side band portions, wherein said front band portion and said side band portions are substantially flat and have a continuous bottom edge portion and a continuous top edge portion, said collector lip being coextensively connected to said front band portion and said side band portions along said continuous bottom edge portion to define said collector space, said continuous top edge portion comprising a downward sloping edge portion for facilitating the flow of perspiration into said collection space, said collector lip having a freely extending top edge, the height dimension of said front band portion and said side band portions common to said continuous top edge portion being greater than the height dimension of said collector lip including said freely extending top edge by an extent substantially equal to the height dimension of said downwardly sloping edge portion, wherein said rear band portion includes a first band end which includes a first band connector, and a second band end which includes a second band connector, said first band connector and said second band connector being engageable with, one another to affix said head band apparatus circumferentially about said wearer's head with said front band portion on said wearer's forehead, and wherein said front band portion, said first band end, said second band end, and said side band portions are of a unitary, nonabsorbent flexible material.

2. The apparatus of claim 1 wherein:

said first rear band portion connector includes a first hook or loop material, and said second band connector includes a second loop or hook material.

3. The apparatus of claim 1 wherein said band includes:

a first band rear band portion end which includes a pair of strap lock rings, a second band end which includes a quantity of third hook or loop material on an outside surface of said second band end, and a quantity of fourth loop or hook material on said outside surface of said second band end distal from said third hook or loop material.

* * * * *